United States Patent [19]

Huddle et al.

[11] Patent Number: 4,699,162

[45] Date of Patent: Oct. 13, 1987

[54] UTENSIL WASHER WITH HYDRAULICALLY DRIVEN BASKET

[75] Inventors: Richard F. Huddle; Harley E. Huddle, Sr., both of Cincinnati; Vernon Baldwin, Fairfield, all of Ohio

[73] Assignee: A-F Industries, Inc., Cincinnati, Ohio

[21] Appl. No.: 700,100

[22] Filed: Feb. 11, 1985

[51] Int. Cl.[4] ..... B08B 13/00

[52] U.S. Cl. ..... 134/141; 134/94; 134/98

[58] Field of Search ..... 134/137, 138, 139, 140, 134/141, 94, 98, 146; 415/202, 212 R

[56] References Cited

U.S. PATENT DOCUMENTS

| | | | |
|---|---|---|---|
| 976,109 | 11/1910 | Wellman | 415/212 |
| 1,605,021 | 11/1926 | Barker | 134/141 |
| 1,767,615 | 6/1930 | Rabinowitz | 134/141 |
| 2,029,695 | 2/1936 | Barozzi | 134/141 X |
| 2,151,437 | 3/1939 | Ohme et al. | 134/141 X |
| 2,655,163 | 10/1953 | Lyman | 134/141 |
| 3,060,944 | 10/1962 | Brollo | 134/98 X |
| 3,070,103 | 12/1962 | Pickard et al. | 134/141 X |
| 3,133,547 | 5/1964 | Dannenmann et al. | 134/140 X |
| 3,973,989 | 8/1976 | Senger | 134/138 X |
| 4,294,272 | 10/1981 | Klaiber | 134/138 |

FOREIGN PATENT DOCUMENTS 1133365 11/1956 France .

*Primary Examiner*—Harvey C. Hornsby
*Assistant Examiner*—Frankie L. Stinson
*Attorney, Agent, or Firm*—Frost & Jacobs

[57] ABSTRACT

A washer for utensils, such as baking pans and trays, having a spray chamber containing a movably mounted utensil rack and spray nozzles arranged to impinge upon articles stacked in the rack; a source for supplying wash and rinse water under pressure to the spray nozzles, and a water motor for moving the rack relative to the spray nozzles, the water motor comprising a waterwheel rotatably journaled in a housing, the waterwheel having a plurality of radially extending blades driven by additional spray nozzles mounted on the housing and positioned to direct jets of water onto the blades adjacent their outer ends, the additional spray nozzles for driving the waterwheel being connected to the source supplying wash and rinse water to the spray nozzles utilized to spray the articles being cleaned, the waterwheel mounting drive mechanism for moving the rack relative to the spray chamber so as to obtain complete and efficient washing of all surface of the articles being cleaned.

5 Claims, 4 Drawing Figures

UTENSIL WASHER WITH HYDRAULICALLY DRIVEN BASKET

This invention relates to washers, and has to do more particularly with washers of the type utilized by bakeries and other commercial establishments to clean baking pans, trays, and similar utensils.

BACKGROUND OF THE INVENTION

Commercial washers normally comprise a spray chamber or vat containing one or more racks or baskets in which the articles to be cleaned are placed, the articles being cleaned by the action of spray nozzles which are positioned to cause streams of wash and rinse water to impinge upon the articles.

Various types of basket and spray arrangements have been proposed to insure complete cleaning of the articles being washed ranging from stationary racks and spray nozzles to various combinations of fixed and rotatable spray nozzles and/or rotatable or oscillatory baskets or racks. For example, in its simplest form, the washer may comprise one or more stationary racks surrounded by stationary spray nozzles positioned to cause jets of liquid to impinge upon the articles from the top, bottom and sides of the spray chamber. To enhance the cleaning action, the spray nozzles lying above and below the racks may be mounted on rotating arms which enhance the effectiveness of the spraying action and the ability of the jets of water to contact all surfaces of the articles which are stacked in the trays.

The effectiveness of the sprays also can be materially enhanced by utilizing rotating or oscillating baskets or trays which act to move the articles relative to the spray nozzles. While it has been recognized that movable baskets enhance the cleaning and rinsing action of the spray nozzles, moving baskets add materially to the cost of the washer in that a separate source of power must be provided to drive the basket, including a gear train or other drive mechanism for connecting the basket or rack to the power source, which is normally an electric motor. While many potential users recognize the enhanced efficiency of washers utilizing moving baskets, they are unwilling to pay a higher price for the washer and hence are willing to settle for a less expensive unit even though it does not have the cleaning capabilities of the higher priced units.

The present invention materially reduces the cost disparity between washers with movable baskets or trays and those with stationary ones by eliminating the need for a separate source of power and an expensive gear train to drive the basket or rack, the motor and gear train being replaced by a simple hydraulically driven mechanism utilizing the spray water as its source of power.

SUMMARY OF THE INVENTION

In accordance with the present invention, the pump which is utilized to circulate wash and rinse water through the spray nozzles is also utilized to drive the basket, a portion of the spray water supplied to the conventional spray nozzles being diverted to power a simple water motor which drives the basket or rack.

The water motor comprises a simple and inexpensive waterwheel having a plurality of radially extending blades adapted to be driven by one or more jets of water positioned to impinge upon the blades of the waterwheel, the wheel being rotatably mounted on a shaft carrying a friction roller adapted to contact and drive a basket carrying turntable rotatably mounted in the spray chamber.

The waterwheel is mounted in a housing underlying the rotatable turntable adjacent its periphery with the friction roller projecting upwardly for contact with the periphery of the turntable, the waterwheel housing being pivotally mounted and spring biased to cause the friction roller to frictionally engage the periphery of the turntable, the rotatating roller thereby driving the turntable and the basket mounted thereon.

Preferably, the blades of the waterwheel are driven by a pair of spray nozzles the first of which is position substantially tangential to the path of rotation of the waterwheel. The second nozzle is angularly disposed with respect to the first nozzle and positioned so that its spray will impinge upon the distal ends of the blades, which are preferably inclined at an angle with respect to the body of the blades. This arrangement insures rotary movement of the blades, particularly during start up, when the blades facing the first spray nozzle might be in equilibrium positions where the first spray alone would be ineffective to initiate rotation of the wheel.

DESCRIPTION OF THE PREFERRED EMBODIMENT

Figure 1:
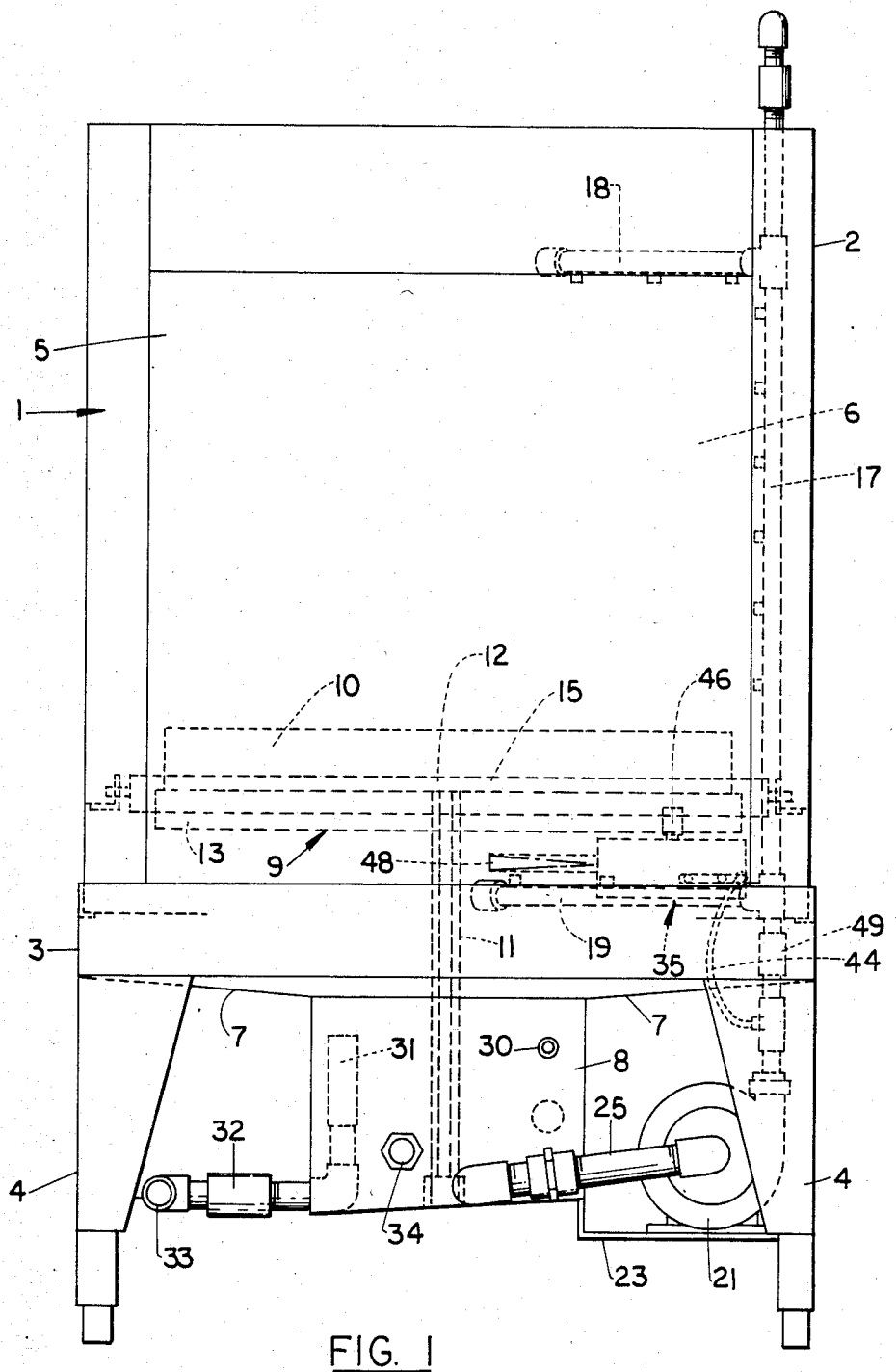
FIG. 1 is a front elevational view of a washer in accordance with the invention.

Referring first to FIG. 1, the washer, indicated generally at 1, comprises a rectangular housing 2 supported on a base 3 having legs 4. On its front side the housing is provided with a vertically movable access door 5 which closes the spray chamber 6 defined by the walls of the housing and the closed door. The spray chamber terminates at its lower end in a downwardly and inwardly inclined bottom wall 7 opening into a well or reservoir 8 adapted to be filled with water and the desired amount of cleaning compound to provide a wash solution which is recirculated during the washing cycle, as will be explained hereinafter.

In accordance with the invention, the washer 1 is provided with a circular turntable or basket holder 9 adapted to receive a basket or utensil rack 10 in which articles to be cleaned will be stacked in conventional fashion. The turntable 9 is rotatably mounted on a shaft 11 projecting upwardly from the bottom of the well 8. Preferably the turntable 9 comprises a wheel-like structure having a hub 12 rotatably journaled on the shaft 11, with a series of radially disposed spokes 13 supporting an annular rim 14, as best seen in FIG. 3. In order to facilitate the loading of a filled basket or rack 10 onto the turntable 9, a roller 15, as seen in FIGS. 1 and 2, may be positioned adjacent the access door 5 in alignment with the upper surface of the turntable 9 so that the basket or rack 10 may be easily inserted in the spray chamber and seated on the turntable 9.

Figure 2:
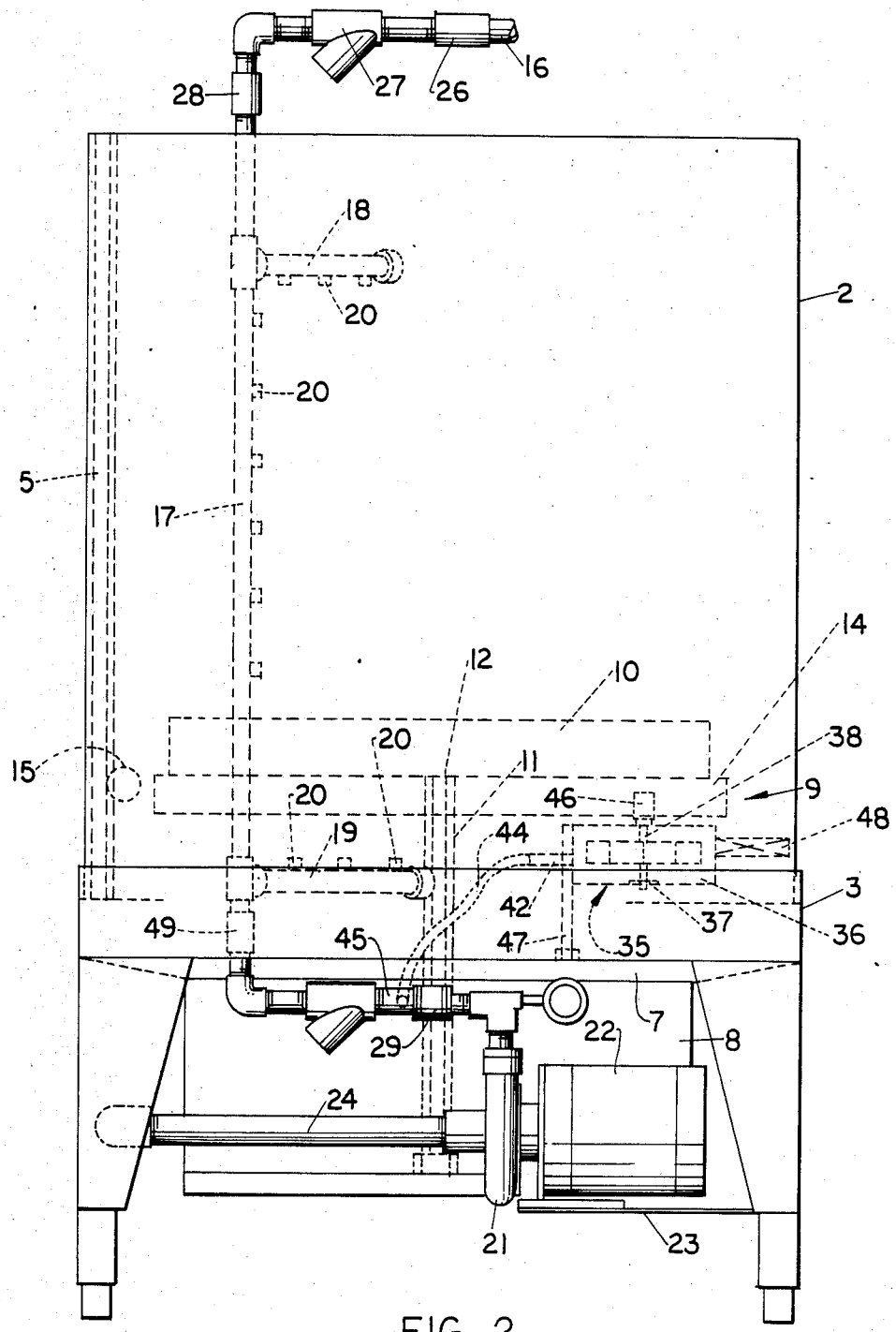
FIG. 2 is a side elevational view taken from the right side of FIG. 1.
Figure 3:
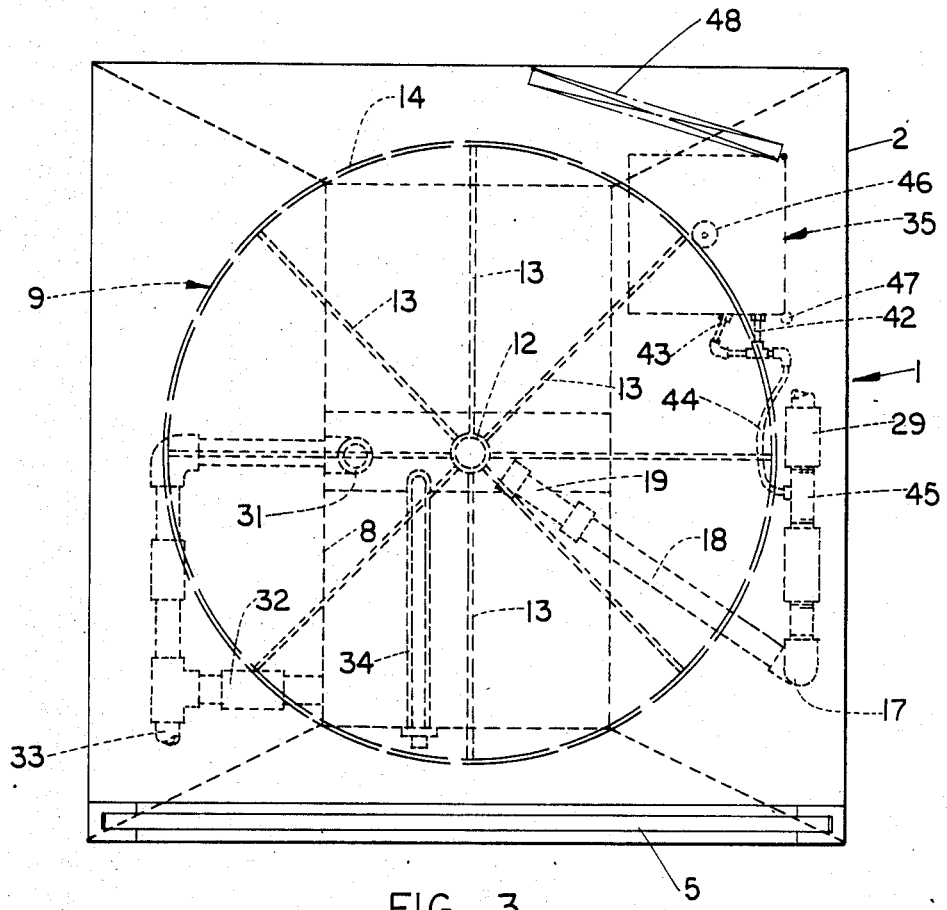
FIG. 3 is a plan view of the washer.

In the illustrated embodiment, fresh heated water under pressure is introduced into the washer through conduit 16, seen in FIG. 2, the water passing downwardly through vertical spray pipe 17 and upper and lower horizontal spray pipes 18 and 19, respectively, each of the spray pipes being provided with a plurality of spray nozzles 20 positioned to spray streams of water over the articles being cleaned. It will be understood that the spray arrangement illustrated is exemplary only, and that neither the number of spray pipes not their locations constitute a limitation on the invention, the essential consideration being the positioning of the various spray nozzles so that jets of water will impinge upon all surfaces of the articles being cleaned as the turntable 9 rotates the article contained in the basket or rack 10.

At its lowermost end the vertical spray pipe 17 is connected through various fittings to a pump 21 adapted to be driven by an electric motor 22 mounted on a platform 23 extening between reservoir 8 and one of the legs 4 of the washer. The inlet side of the pump 21 is connected through conduits 24 and 25 to the bottom of reservoir 8, as seen in FIG. 1.

In operation, heated water 18 is initially introduced into the system through conduit 16, solenoid valve 26, strainer 27 and check valve 28. During the introduction of water into the system through conduit 16, a check valve 29 adjacent the outlet side of pump 21 prevents the incoming water from flowing to the pump 21 the incoming water being sprayed onto the articles through the various spray nozzles in vertical spray pipe 17 and upper and lower horizontal spray pipes 18 and 19. The initial spray or pre-wash cycle continues until sufficient water has been introduced to fill the reservoir 8 to the level of a sensor 30, seen in FIG. 1, which actuates the solenoid valve 26 to turn off the supply of fresh water. Thereafter, the pump 21 will be actuated to pump fresh water from the reservoir through the spray pipes 17, 18 and 19 in a cleaning operation. It will be understood that the desired amount of cleaning compound will have been initially introduced into the reservoir 8 either manually or by an automatic dispenser. The check valve 29 adjacent the pump 21 permits water from the pump to pass upwardly through the various spray pipes, while at the same time the check valve 28 at the top of spray pipe 17 prevents the wash water from flowing beyond the spray pipes.

Following the washing cycle, which may be of any desired duration, rinse water is introduced into the system through conduit 16. Water in the reservoir 8 may be evacuated either by means of the overflow pipe 31, seen in FIGS. 1 and 3, or through the discharge valve 32, the discharged water in either event flowing to a drain through outlet 33. When the water in reservoir 8 is being recirculated, it may be further heated by means of a heating element 34 extending into reservoir 8. If desired, the wash water may be evacuated from reservoir 8 and the reservoir utilized to recirculate the rinse water, thereby conserving the amount of water used for rinsing. It is again pointed out that the spray arrangement just described is exemplary only and may be varied as desired the essential consideration insofar as the present invention is concerned being the provision of a source of spray water, whether wash water or rinse water, which may be utilized in part to drive a water motor adapted to rotate the turntable 9.

Figure 4:
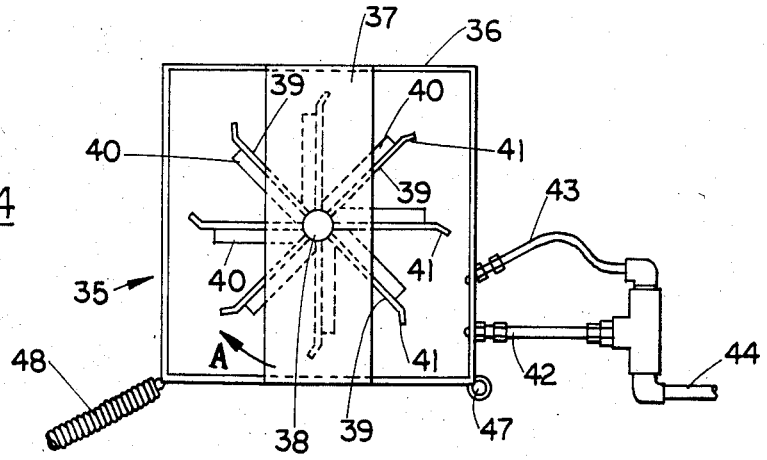
FIG. 4 is a bottom plan view of the water motor and associated spray nozzles.

In accordance with the invention, a water motor 35 is mounted adjacent a lower corner of the housing 2 immediately beneath the turntable 9, the water motor comprising a housing 36 having enclosing side and top walls, the bottom of the housing being open except for a centrally disposed brace 37. A shaft 38 is rotatably journaled between the top of the housing and brace 37, the shaft mounting a waterwheel 38 composed of a series of radially disposed blades 39, as best seen in FIG. 4. Each of the blades is vertically disposed and preferably has a horizontally disposed flange 40 extending along the lowermost side edge of the blade to increase its efficiency. Preferably, the flange terminates short of the distal end of the blade, which is inclined at an acute angle relative to the remainder of the blade, to provide an inclined tip 41.

The blades are preferably driven by a pair of spray nozzles 42 and 43 attached to the housing 36, the spray nozzles being connected by conduit 44 to a fitting 45 connecting the vertical spray pipe 17 to the pump 21, the fitting 45 lying between the spray pipe 17 and the check valve 29.

The spray nozzle 42 is positioned tangential with respect to the path of rotation of the blades 39 of the waterwheel 38 so as to cause a stream of water to impinge upon the blades toward their outer ends, thereby causing the blades to rotate in the direction of the arrow A. The nozzle 43 is angularly disposed with respect to the nozzle 42 and positioned to cause a stream of water to impinge on the angular tips at the ends of the blades, the arrangement insuring that the blades will be rotated irrespective of their positions relative to the spray nozzle 42 at start-up, thereby preventing the blades from assuming an equilibrium position in which the force of the spray from nozzle 42 is insufficient to initiate rotation of the blades.

As will be seen in FIGS. 1 and 2, the shaft 38 of the waterwheel projects upwardly through the housing where it mounts a roller 46 preferably covered with rubber or other friction material adapted to contact the rim 14 of the turntable 9. Thus, rotation of the waterwheel imparts rotational movement to the roller 46 which in turn rotates the turntable 9.

To insure positive frictional engagement between the roller 46 and the rim 14 off the turntable, the housing 36 is pivotally mounted on a pivot pin 47 which coacts with a spring 48 extending between an adjacent corner of the housing 35 and the washer housing 2, the spring serving to bias the roller 46 into frictional engagement with the rim of the turntable 9.

As should now be apparent, the invention provides a simple and inexpensive yet efficient water powered mechanism for driving the turntable of the washer basket. The piping arrangement is such that when water is initially introduced into the system through conduit 16 to fill the reservoir 8, the water will flow downwardly through spray pipe 17 until it reaches the check valve 29, which is downstream of the fitting 45, and consequently water will be supplied to the nozzles 42 and 43 through conduit 44, thereby rotating the turntable during the pre-wash cycle. If it is desired to prevent rotation of the turntable during the pre-wash cycle, a solenoid valve 49 may be interposed between spray pipe 17 and fitting 45, so that the turntable may be selectively driven or retained in stationary position during part or all of the pre-wash cycle, and also during subsequent rinse cycles.

When the reservoir 8 is filled, the solenoid valve 26 will be closed and the pump 21 actuated to pump washing solution from the reservoir 8 upwardly through the spray pipes 17, 18 and 19, the check valve 29 opening for such purposes and the check valve 28 closing. During the washing cycle a portion of the wash solution will be fed to the nozzles 42 and 43, thereby driving the water motor and rotating the turntable, the portion of the wash water used to drive the water motor returning to the reservoir for recirculation through the open bottom of the waterwheel housing 36. Following the wash cycle, the valve 26 will be reopened to cause fresh rinse water to enter the system, excess water being evacuated through either the overflow pipe 31 or the discharge valve 32. Preferably the solenoid valve 49 will be closed and the pump 21 utilized to provide water to the nozzles 42 and 43, thereby permitting the turntable to rotate continuously without interruption during the wash and rinse cycles.

Numerous modifications may be made in the invention without departing from its spirit and purpose. As previously pointed out, the spray system may take various forms and may utilize as many spray pipes as may be desired, including rotary sprays. It will also be evident that the water motor may be used to reciprocate a reciprocally movable basket or basket carrier rather than rotate a turntable, in which event the friction roller will be replaced by an eccentric cam and lever arm mechanism to effect oscillatory movement of the basket carrier.

What is claimed is:

1. A washer for utensils and the like comprising a spray chamber, utensil containing rack means movably mounted in said spray chamber, said rack means comprises an annular turntable rotatably mounted within said spray chamber, spray means in said chamber positioned to impinge upon articles stacked in said rack means, said spray means having an inlet end adapted to connect to a source of fresh water under pressure and a distal end remote from said inlet end, a first valve means at the inlet end of said spray means for opening and closing said spray means to the flow of water from the source of fresh water under pressure, a second valve means at the distal end of said spray means oriented to prevent water introduced into said spray means through a first valve means from being discharged through the distal end of said spray means, a reservoir underlying said spray chamber for collecting water discharged by said spray means, a pump connected to the distal end of said spray means and to said reservoir for pumping water from said reservoir into said spray means through the distal end thereof, a water motor for moving said rack relative to said spray means, said water motor comprising a housing pivotally mounted for movement relative to said turntable, spring means biasing said housing in the direction of said turntable, a waterwheel rotatably journaled in said housing, nozzle means positioned to direct a spray of water against said waterwheel to cause rotation thereof, said nozzle means being connected to said spray means adjacent the distal end thereof upstream of said second valve means, and drive means operatively connecting said water motor to said rack, said drive means comprises said friction roller mounted on said waterwheel and rotatable therewith, said friction roller being positioned to engage the periphery of said turntable, whereby said friction roller is resiliently urged into contact with the periphery of said turntable, and said rack means is driven by said water motor both when fresh water in introduced into said spray means through its inlet end and when water is pumped into the distal end of said spray means from said reservoir.

2. The washer claimed in claim 1 wherein said waterwheel comprises a plurality of radially extending blades, wherein said nozzle means comprises a first spray nozzle positioned substantially tangential to the path of rotation of said blades so as to direct a spray of water against the blades adjacent their distal ends, said nozzle means including a second spray nozzle angularly disposed with respect to said first spray nozzle and positioned to direct a second spray of water against the blades adjacent their distal ends, the distal ends of said blades being angularly disposed relative to the remainder of said blades in the direction of their rotation, whereby rotation of the blades is insured during start-up of the water motor.

3. The washer claimed in claim 1 including a third valve means adjacent the distal end of said spray means and upstream of said nozzle means, whereby when said third valve means is closed, fresh water may be introduced into said spray means and the pump utilized to provide water under pressure to said nozzles, thereby permitting continuous movement of the rack means without interruption.

4. A water motor for driving the movable basket of a washer for utensils and the like having spray means and a source of water pressure for supplying water to said spray means, said water motor comprising a housing, means for mounting said housing for pivotal movement relative to the basket of the washer, a waterwheel rotatably journaled in said housing, said waterwheel comprising a plurality of radially extending blades, the outermost ends of said blades being angularly disposed relative to the remainder of the blades in their direction of rotation, a first spray nozzle positioned substantially tangential to the path of rotation of said blades adjacent their outermost ends to direct a first spray of water against said blades to cause rotation thereof, a second spray nozzle angularly disposed with respect to said first spray nozzle and positioned to direct a second stream of water against the outermost ends of said blades, means for connecting said nozzles to the source supplying water under pressure to the spray means of the washer, and drive means for operatively connecting said waterwheel to the movable basket of the washer, whereby rotation of the blades is insured during start-up of the water motor, said drive means comprises a friction roller mounted on said waterwheel for rotation therewith.

5. The water motor claimed in claim 4 including spring means for biasing said water motor in the direction of the basket.

* * * * *